US006450610B1

(12) United States Patent
Shimura

(10) Patent No.: US 6,450,610 B1
(45) Date of Patent: Sep. 17, 2002

(54) SCANNING APPARATUS

(75) Inventor: Norio Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/656,067

(22) Filed: Sep. 6, 2000

(30) Foreign Application Priority Data

Sep. 6, 1999 (JP) ..... 11-252285

(51) Int. Cl.[7] ..... B41J 29/13
(52) U.S. Cl. ..... 347/37; 347/108
(58) Field of Search ..... 347/5, 23, 37, 347/108, 56, 57, 152; 400/703; 700/79; 358/474

(56) References Cited

U.S. PATENT DOCUMENTS

| | | | | |
|---|---|---|---|---|
| 4,313,124 A | | 1/1982 | Hara | 347/57 |
| 4,345,252 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,767,988 A | * | 6/1998 | Dobbs et al. | 358/474 |
| 5,828,389 A | | 10/1998 | Yamaguchi et al. | 347/23 |
| 5,842,800 A | | 12/1998 | Bailey et al. | 400/703 |
| 6,065,831 A | | 5/2000 | Kawaura et al. | 347/108 |
| 6,208,906 B1 | * | 3/2001 | Miyasaka et al. | 700/79 |

FOREIGN PATENT DOCUMENTS

| | | |
|---|---|---|
| EP | 0 694 393 | 1/1996 |
| EP | 0 844 094 | 5/1998 |
| JP | 54-56847 | 5/1979 |
| JP | 59-123670 | 7/1984 |
| JP | 59-138461 | 8/1984 |
| JP | 60-71260 | 4/1985 |
| JP | 10-44396 | 2/1998 |

* cited by examiner

*Primary Examiner*—Anh T. N. Vo
(74) *Attorney, Agent, or Firm*—Fitzpatrick, Cella, Harper & Scinto

(57) ABSTRACT

An ink jet printer which has a cover that can be opened to expose the interior of the apparatus to allow the ink tank and print head to be replaced and in which when the cover is detected to be opened, the apparatus is set so that the replacement of the ink tank or print head can be made, when the cover is opened for other purposes not accompanied by the replacement, unnecessary operations such as the replacement enable setting are eliminated. Hence, when the cover is opened during a standby state in which no print data is received and there is no error, the above setting (e.g., moving the print head to the replacement position) is permitted. When the cover is opened during the printing operation or in the presence of a print medium jam error, the apparatus does not permit the setting and waits for the cover to be closed. In this way, the predetermined setting in the event of the opening of the cover is properly controlled according to the mode of the apparatus to improve the operability and the operation efficiency.

19 Claims, 7 Drawing Sheets

SCANNING APPARATUS

This application is based on Patent Application No. 11-252285 (1999) filed Sep. 6, 1999 in Japan, the content of which is incorporated hereinto by reference.

BACKGROUND OF THE INVENTION

1. Field of the Invention

The present invention relates to a scanning apparatus which scans a function device and a medium relative to each other to have the function device execute a predetermined function and which enables a predetermined mounting or dismounting operation associated with the function device. More specifically, the invention relates to a scanning apparatus, such as a printer, which uses as a print head the function device for applying a print agent to a print medium and which enables the print head or a print agent supply means for the print head to be removably mounted.

2. Description of the Related Art

Scanning apparatuses of this kind, for example, such printing apparatuses as ink jet printers, each have a member such as a front cover that can be opened for access to the interior of the apparatus to allow for replenishing the print agent (replacing the ink tanks) when the print agent or ink runs out or for changing between a color print head and a monochrome print head when switching between color printing and monochrome printing. The apparatus also has means for detecting the open state of the front cover and, while the front cover open state is detected, is set to enable the replacement of the print head.

In the apparatus using such means, the above-described setting is made simply in response to the opening state of the front cover. Hence, when the cover is opened though there is no need to open or replace the head in some modes of the apparatus, or when the cover is opened for other purposes not accompanied by the head replacement, the above setting may be made, which is not necessary, giving rise to a problem of operability and operation efficiency.

SUMMARY OF THE INVENTION

An object of the present invention is to provide a scanning apparatus with an excellent operability and operation efficiency which properly controls, according to the state of the apparatus, predetermined settings of the apparatus while the front cover is open.

In a first aspect of the present invention, there is provided a scanning apparatus for scanning a function device and a medium relative to each other to have the function device execute a predetermined function, comprising:

a cover member for opening and closing an interior of the apparatus;

means for detecting an open/closed state of the cover member;

means for making a setting to enable a predetermined mounting and dismounting operation associated with the function device; and means for permitting the setting to enable the predetermined mounting and dismounting operation when the cover member is detected to be opened while the apparatus is in a predetermined function execution standby state.

In a second aspect of the present invention, there is provided a control method of a scanning apparatus having a carriage for detachably mounting a function device for executing a predetermined function and means for scanning the carriage along a main scanning direction, the scanning apparatus making the function device mounted on the carriage to execute the predetermined function during the main scanning of the carriage, the method comprising the steps of:

making a setting to enable a predetermined mounting and dismounting operation associated with the function device;

detecting an open/closed state of a cover member provided with the apparatus, the cover member being disposed to cover a predetermined space including a position at which the predetermined mounting and dismounting operation of the function device mounted on the carriage is enabled; and permitting the setting to enable the predetermined mounting and dismounting operation when the cover member is detected to be opened while the apparatus is in a standby state of the predetermined function execution by the function device.

In a third aspect of the present invention, there is provided a printing apparatus having a carriage for detachably mounting a unit for executing a predetermined function and means for scanning the carriage along a main scanning direction, in a state that a print head for executing a printing function is mounted on the carriage as the unit, the apparatus making the print head to execute the printing function during the main scanning of the carriage, and the apparatus comprising:

a cover for opening and closing an interior of the apparatus, the cover being disposed to cover a predetermined space including a replacement position for replacing the unit mounted on the carriage, and the replacement position being in an area in which the carriage is scanned by the scanning means;

means for judging a state of the apparatus;

means for detecting a state of the cover; and means for controlling to scan the carriage to the replacement position by the scanning means or not according to the judgment result by the judging means, when a detection that the cover is displaced from a closed state to an open state is made based on the detection result by the detecting means.

In a fourth aspect of the present invention, there is provided a control method of a printing apparatus having a carriage for detachably mounting a unit for executing a predetermined function and means for scanning the carriage along a main scanning direction, in a state that a print head for executing a printing function is mounted on the carriage as the unit, the apparatus making the print head execute the printing function during the main scanning of the carriage, and the method comprising the steps of:

detecting an open/closed state of a cover provided with the apparatus, the cover being disposed to cover a predetermined space including a replacement position for replacing the unit mounted on the carriage, and the replacement position being in an area in which the carriage is scanned by the scanning means;

judging a state of the apparatus; and controlling the scanning of the carriage by the scanning means when the cover is displaced from a closed state to an open state, and controlling to scan the carriage to the replacement position by the scanning means or not according to the state of the apparatus.

The above and other objects, features and advantages of the present invention will become more apparent from the following description of embodiments thereof taken in conjunction with the accompanying drawings.

DETAILED DESCRIPTION OF THE PREFERRED EMBODIMENT

The present invention will be described in detail by referring to the accompanying drawings.

[Example Configuration of Printing Apparatus]

Figure 1:
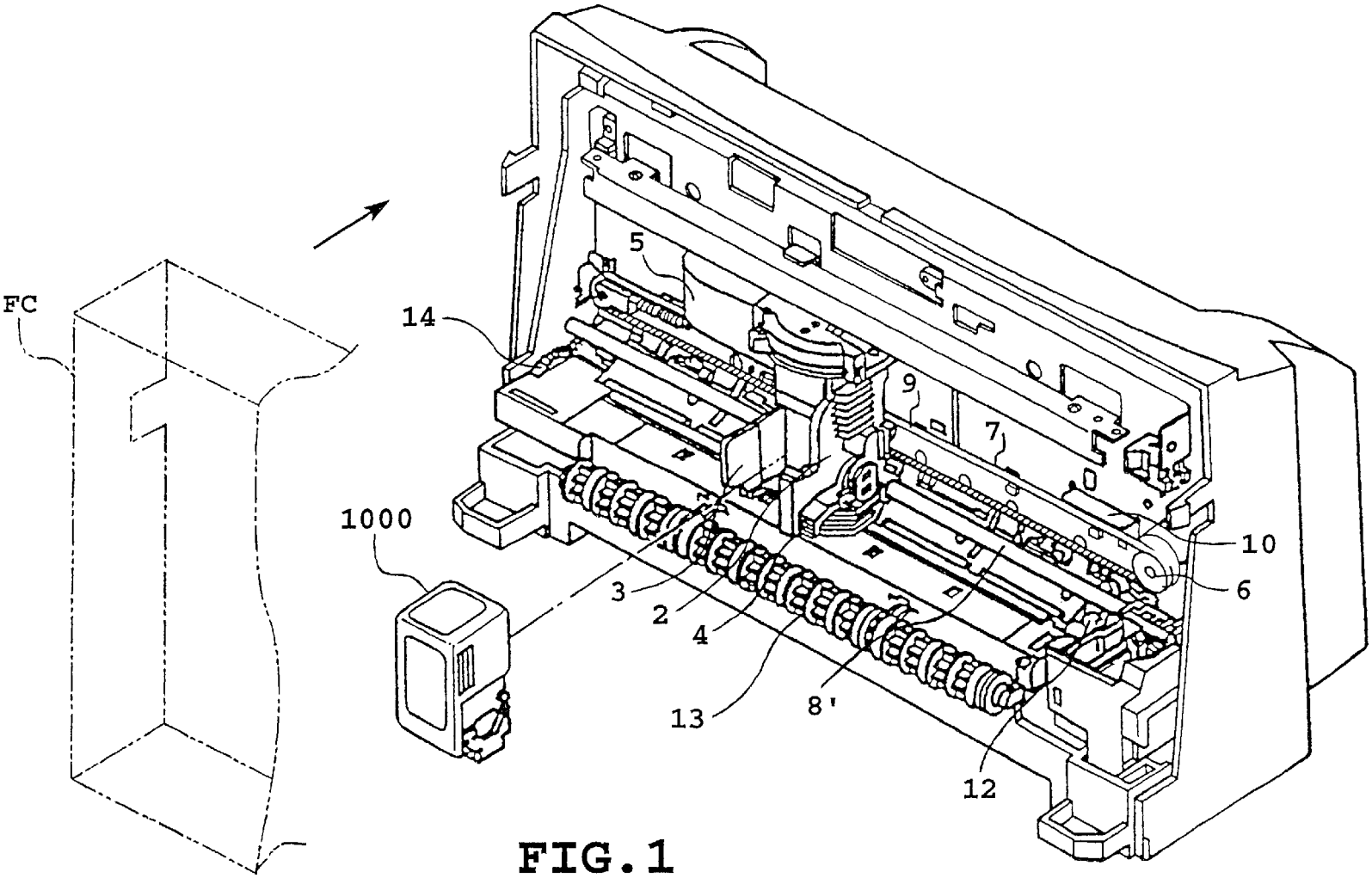
FIG. 1 is a perspective view of an example construction of an ink jet printer as a preferred printing apparatus to which an embodiment of the present invention is applied.

FIG. 1 is a perspective view showing an example construction of an ink jet printer as a preferred printing apparatus that applies or implements this invention. The figure shows a state of the interior of the apparatus with the front cover FC removed. The front cover FC needs only to be able to open the interior of the apparatus for the head replacement and other operations. It may either be separable completely from the apparatus body or rotatably hinged to the apparatus body.

In the figure, reference numeral 1000 represents a replaceable head cartridge and denoted by 2 is a carriage unit for detachably holding the head cartridge 1000. Denoted by 3 is a holder for fixing the head cartridge 1000 to the carriage unit 2. After the head cartridge 1000 is mounted in the carriage unit 2, operating a cartridge fixing lever 4 causes the holder 3 to press the head cartridge 1000 against the carriage unit 2. This holding action under pressure positions the head cartridge 1000 and at the same time brings into contact an electric contact for signal transmission provided in the carriage unit 2 and an electric contact on the side of the head cartridge 1000. Designated by 5 is a flexible cable to transmit electric signals to the carriage unit 2.

Denoted by 6 is a carriage motor or a drive source for reciprocally moving the carriage unit 2 along the main scan directions. A carriage belt 7 transmits the drive force of the motor to the carriage unit 2. A guide shaft 8' extends along the main scan directions to support the carriage unit 2 and guide its movement. Designated by 9 is a transmission type photocoupler attached to the carriage unit 2. Designated by 10 is a light intercepting plate provided near a carriage home position. When the carriage unit 2 reaches the home position, the light intercepting plate 10 intercepts a light axis of the photocoupler 9, detecting that the carriage is at the home position. Designated by 12 is a home position unit including a cap member for capping the front surface of the head cartridge 1000 formed with an ink ejection unit (described later), a suction means for evacuating the interior of the cap by suction and a member for wiping the front surface of the ejection unit.

A discharge roller 13 for discharging the print medium cooperates with a spur-like roller (not shown) to hold the print medium therebetween and discharge it from the printing apparatus. Line feed motor 14 is used to feed the print medium in the sub-scan direction.

The head cartridge 1000 used in this embodiment has an ink tank, which contains ink as a print agent and is detachable from the head cartridge body, and the ejection unit held in the head cartridge body. That is, the head cartridge 1000 of this embodiment allows only the ink tank to be replaced when the ink tank runs out of ink.

The head cartridge 1000 may be one with a monochrome ink tank (e.g., black) and its ejection unit (print head), one with color ink tanks (e.g., cyan, magenta and yellow) and their ejection units (the cartridge may include a black ink tank and its ejection unit), and one with a plurality of ink tanks with different concentrations of the same color ink and their ejection units. It is also possible to prepare a plurality of head cartridges for different densities in printing. By properly selecting these and mounting them on the carriage unit 2 it is possible to switch between a monochrome image forming and a color image forming and between a binary image forming and a half-tone image forming.

Further, in this embodiment, a scanner head can be mounted in the carriage unit 2 instead of the head cartridge 1000. An appropriate control can also be performed as described later when the scanner head is used.

Although the configuration of FIG. 1 is shown to be able to mount one head cartridge 1000, it is also possible to mount a plurality of cartridges for different tones (colors, concentrations). The ink ejection unit may be constructed inseparable from the ink tank or may be supplied with ink through a tube or the like from an ink tank installed in a different part of the apparatus. Further, the ejection unit may use an electrothermal transducer (ejection heater) that generates thermal energy to cause film boiling in ink upon energization which in turn ejects ink.

[Example Configuration of Control System]

Figure 2:
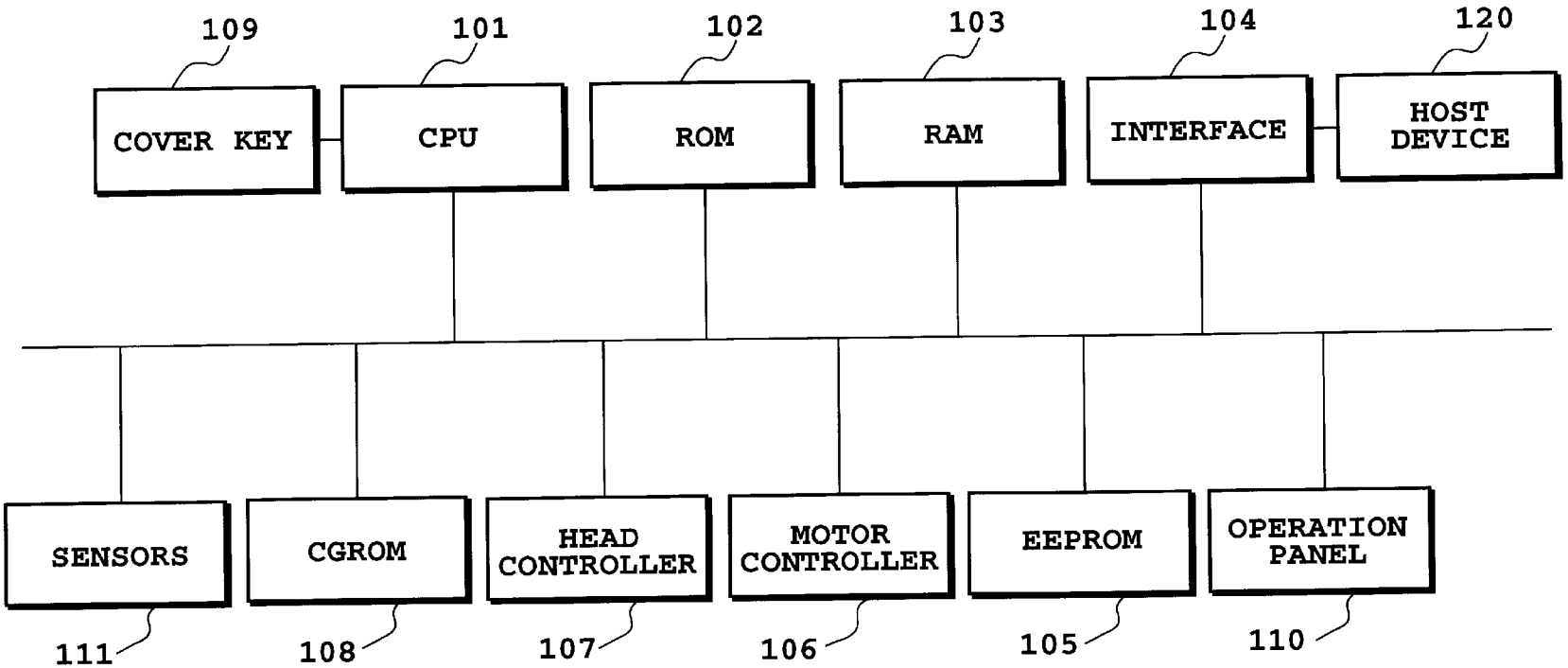
FIG. 2 is a block diagram showing an example configuration of a control system of the printing apparatus of FIG. 1.

FIG. 2 is a block diagram showing an example configuration of a control system of the printing apparatus described above.

In the figure, reference number 101 represents a CPU in the form of microcomputer, which generates print data for the printing apparatus, analyzes a variety of commands, makes a variety of settings according to the inputs from an operation panel and also performs a sequence of steps described later with reference to FIGS. 3 to 7. Denoted by 102 is a ROM storing a program associated with the sequence of steps and tables and other fixed data. A RAM 103 has an area used as a work buffer to develop print data, an area used to store various setting information temporarily, an area used to process the print data as required, and an area used to temporarily store data and commands entered into the interface 104 and scan data and commands to be output from the interface 104.

Designated by 120 is a host device connected via the interface 104 to the printing apparatus. The host device 120 may be a computer for generating and processing/editing data such as images to be printed by the printing apparatus. The host device 120 can also process scan data supplied from the printing apparatus via the interface 104. The host device 120 may also be a digital camera or the like.

Denoted by 106 is a motor controller. This printing apparatus is of a so-called serial scan type, in which the carriage unit 2 carrying the head cartridge 1000 is scanned in the main scan direction once or a plurality of times, followed by the print medium being fed a predetermined distance (sub-scan operation) and by the main scan operation being performed again, with the sequence of these operations repeated to complete the printing on one sheet of print medium. In the serial scan type printing apparatus, the motor controller 106 therefore controls the carriage motor 6, a drive source for moving the carriage in the main scan direction, and also controls a line feed motor 14, a drive source for feeding the print medium in a forward direction (or backward direction). When the scanner head (not shown) is mounted in the carriage unit 2 instead of the head cartridge 1000, similar controls are performed to complete the reading of one sheet of a document (information carrying body).

A head controller 107 performs the function of transferring print data to the ejection unit and the function of controlling the ejection unit to eject ink when the head cartridge 1000 is mounted in the carriage unit 2. When the scanner head is mounted, on the other hand, the head controller 107 executes the function of controlling the scanner head to read an image and the function of transferring the read data. In connection with the head controller 107, it is possible to provide means for identifying various head cartridges and scanner heads mounted on the carriage unit 2 or means for transferring the identification information to the CPU 101. Further, it is also possible to provide means for transferring temperature information of the ejection unit of the head cartridge and ink remainder information of the ink tank.

Denoted by 108 is a CGROM which stores data on characters, numerals and symbols of a variety of languages in the form of image data that can be developed into print data.

Denoted by 109 is a cover key which provides open-close state information of the front cover FC to the CPU 101. The cover key 109 may be a contact type switch with an actuator which is engageable with the front cover FC and displaced or deformed by the open-close operation of the cover, or a non-contact type switch that detects the open-close state of the cover magnetically or optically, or any other appropriate switch.

An operation panel 110 has input means that accept instructions entered by an operator, such as a power switch, a switch for instructing the start of printing, a switch for setting the online state of the apparatus in connection with the host device 120 and a paper feed instruction key, and means for informing the operator of the state of the apparatus (display means such as LCD). Denoted by 111 is a group of sensors to detect predetermined states of the apparatus. These sensors 111 include the photocoupler 9 to detect the home position, a temperature sensor installed at an appropriate location to detect the ambient temperature, a sensor to detect the presence or absence of the print medium to be fed, and a sensor to detect anomalies such as an abnormal feeding (jamming) of print media or documents and other apparatus anomalies.

[Control Procedure]

FIGS. 3 to 7 show example procedures for controlling a predetermined setting of the apparatus according to the mode of the apparatus when the front cover FC is detected to be open. In this embodiment, the predetermined setting refers to positioning the carriage unit 2 at an appropriate position in the main scan range where the head cartridge 1000 or ink tank or scanner head can be mounted or dismounted (hereinafter referred to as a head replacement position). Means for permitting such a mounting/dismounting operation only at the replacement position can be added (e.g., a member that, at only the replacement position, exposes the head cartridge 1000 or scanner head for mounting and dismounting).

Figure 3:
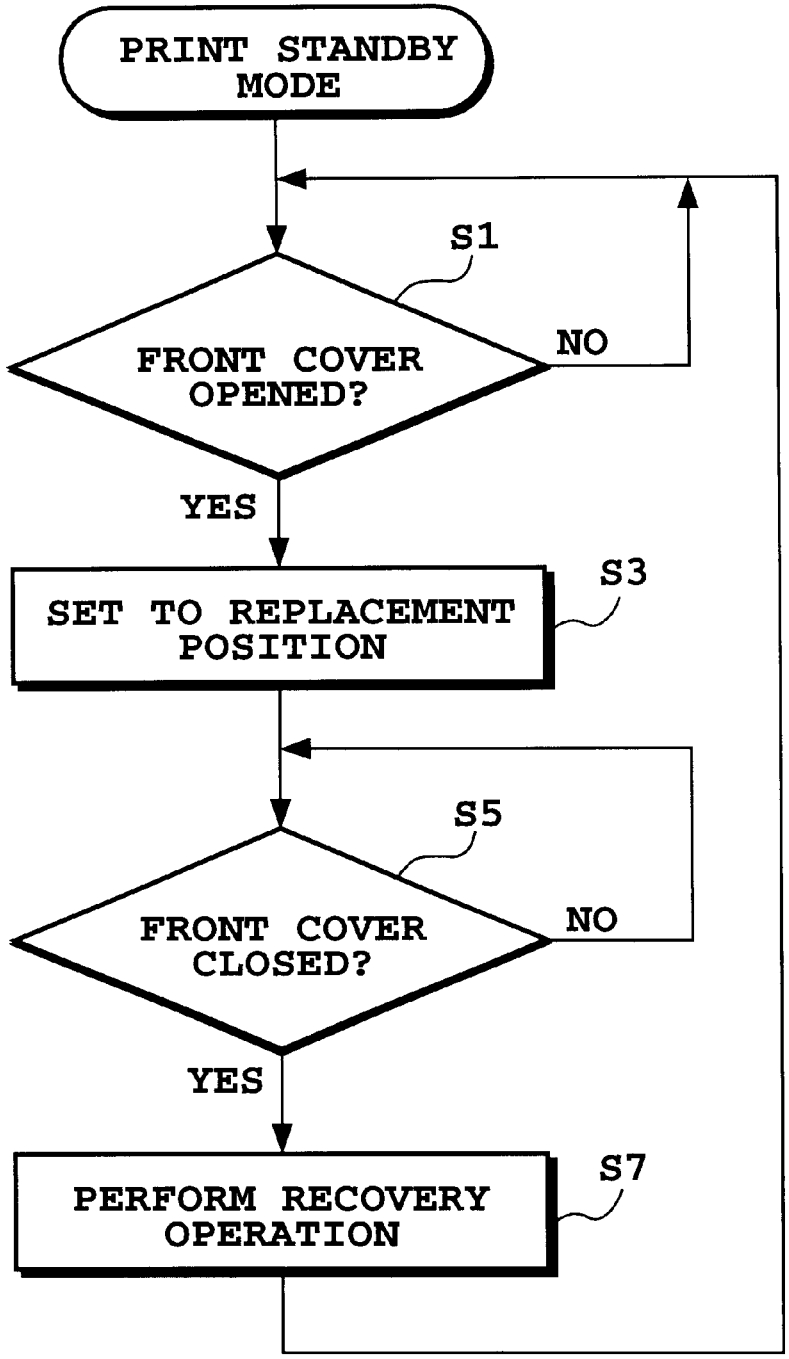
FIG. 3 is a flow chart showing an example procedure when the front cover is opened during a print standby mode.

FIG. 3 shows an example procedure when the printing apparatus is in a print standby mode. When the printing apparatus is turned on and in the print standby mode, i.e., not in a printing mode nor in an error mode, and an open state of the front cover FC is detected (step S1), the carriage unit 2 is moved from a predetermined standby position (e.g., home position) to a head replacement position where the head cartridge 1000 or ink tank can be removed or mounted (step S3). In this state, if the head cartridge 1000 or ink tank is replaced or no operation is performed and then the front cover FC is closed (step S5), the carriage unit 2 is set to the home position. Then, the home position unit 12 including an ejection performance recovery system is operated to remove clogging of the ejection unit and perform suction or wiping to keep the ejection performance in good condition (step S7). The apparatus stays in the print standby mode.

It should be noted that if the time which elapses after a timer was started upon the opening of the cover until the cover is detected to be closed is less than a predetermined time, it is possible to decide that the head cartridge 1000 or ink tank has not been replaced and to return to the print standby mode without performing the ejection performance recovery operation. The similar processing can be done, where the carriage unit 2 is provided with means for detecting the mounted state of the head cartridge 1000 or ink tank, in accordance with judgement as to whether the head cartridge 1000 or ink tank has been replaced or not.

Figure 4:
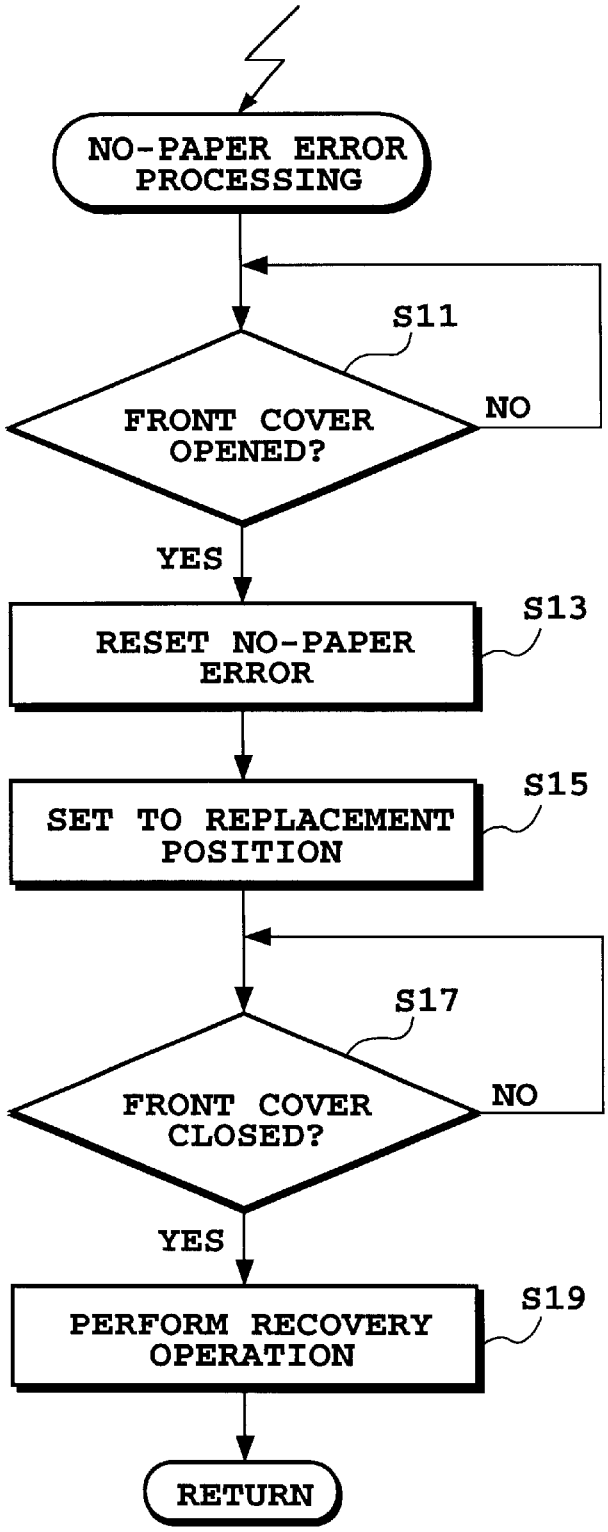
FIG. 4 is a flow chart showing an example procedure when the front cover is opened during a no-paper error mode.

FIG. 4 shows an example procedure performed during a mode that deals with an error arising from the absence of a print medium (no-paper error). This mode is entered when, during the reception of image data or print data or during the paper feed operation activated by the paper feed instruction key, the paper feed sensor provided to the paper feed means detects the absence of paper. Then, when the front cover FC is detected to be open (step S11), the no-paper error is reset (step S13). The carriage unit 2 is moved from the predetermined standby position (e.g., home position) to the head replacement position where the head cartridge 1000 or ink tank can be replaced (step S15). Then, when the operator replenishes the print medium and closes the front cover FC (step S17), the carriage unit 2 is set to the home position and the ejection performance recovery operation is performed as required (step S19) before returning to the main control procedure which resumes the paper feed operation.

If such an error should occur during the paper feed operation triggered by the paper feed instruction key, it may be possible not to perform a further paper feed operation.

Figure 5:
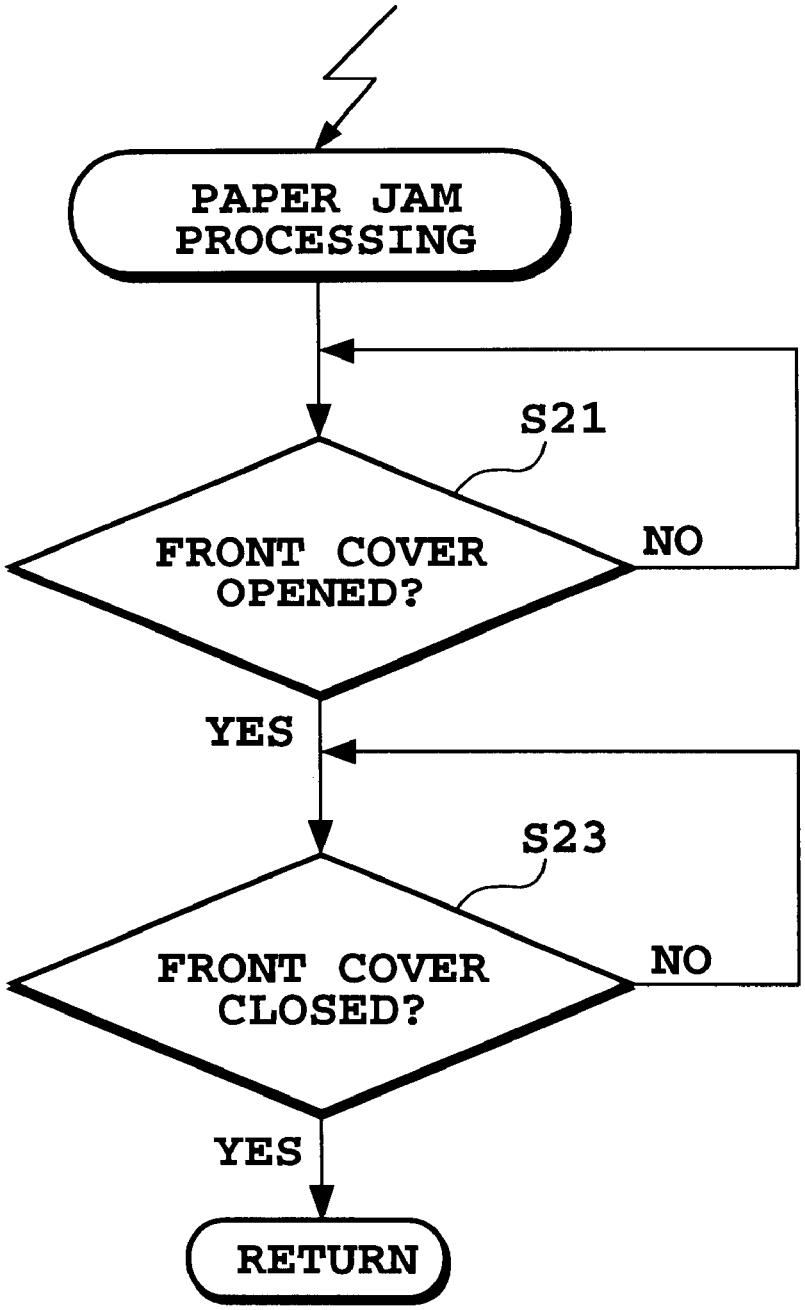
FIG. 5 is a flow chart showing an example procedure when the front cover is opened during a paper jam error mode.

FIG. 5 shows an example procedure performed during a mode that deals with an error arising from an abnormal feeding (jamming) of a print medium (paper jam error). In this mode, when the front cover FC is detected to be open (step S21), it is decided that the cover has been opened to remove the jammed print medium from the paper feeding passage. The procedure waits for the front cover FC to be closed without moving the carriage unit 2 to the head replacement position, i.e., without rendering the head cartridge 1000 or ink tank replaceable (step S23). After the jammed print medium is removed and the paper jam error is eliminated, the procedure waits for the front cover FC to be closed without making a setting for enabling the head cartridge 1000 or ink tank to be replaced. When the front cover FC is closed, the processing returns to the main control procedure to resume the printing from scratch or print the remaining data.

Figure 6:
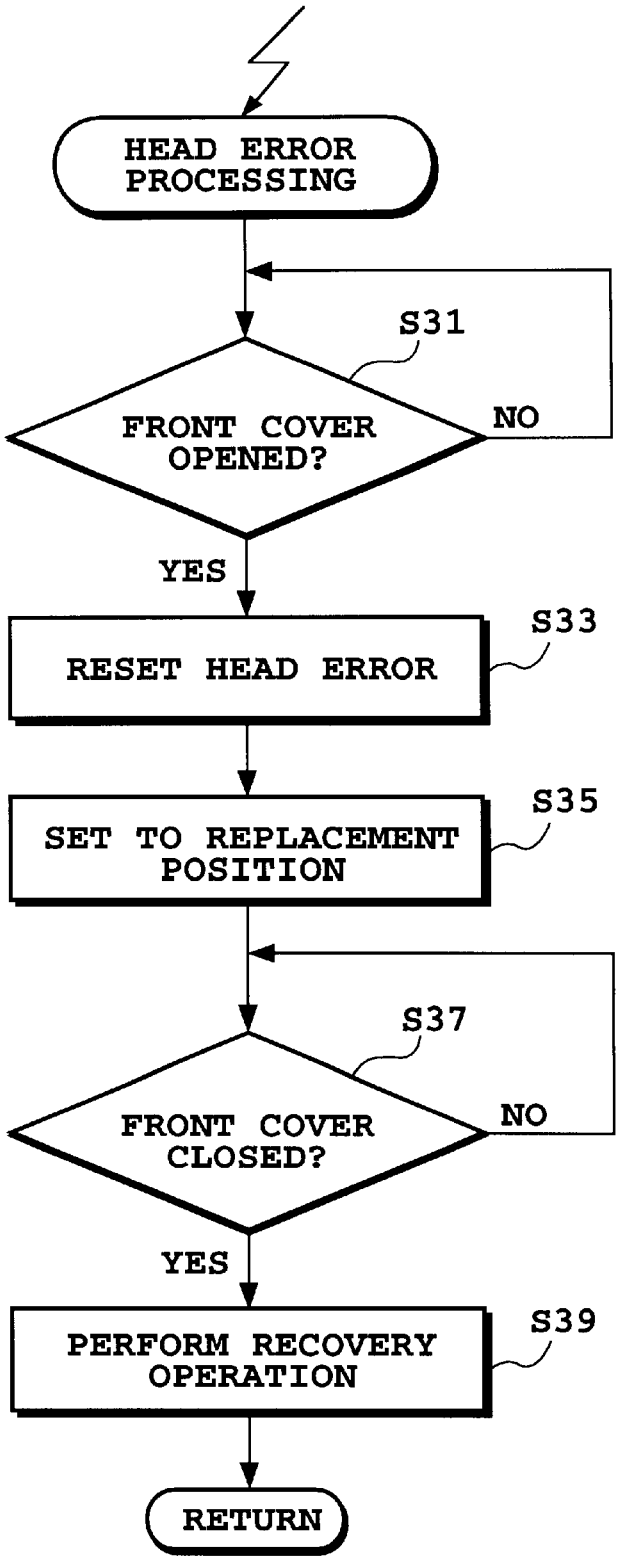
FIG. 6 is a flow chart showing an example procedure when the front cover is opened during a head error mode.

FIG. 6 shows an example procedure performed during a mode that deals with an error occurring when, with the scanner head mounted in the carriage unit 2, an image data or print data is received to start the print operation, i.e., an error occurring when an incompatible head is mounted (head error). When the front cover FC is found to be open (step S31), firstly the head error is reset (step S33). Then, the carriage unit 2 is moved from the predetermined standby position (for example, home position) to the head replacement position where the head cartridge 1000 or ink tank or the scanner head can be replaced (step S35). Further, when the operator performs a predetermined operation (e.g., removing the scanner head and mounting the head cartridge) and closes the front cover FC (step S37), the procedure sets the carriage unit 2 to the home position and performs the ejection performance recovery operation (step S39) before returning to the main control procedure which executes processing according to the received data.

This procedure can also be applied where an incompatible head cartridge is mounted (e.g., where monochrome printing is specified when the head cartridge mounted is for color inks).

Where an image reading is specified when a head cartridge for printing is mounted, almost the same procedure can also be employed to replace it with the scanner head. In this case, however, the step S39 need only be skipped.

Further, in the event of a head error produced when nothing is mounted in the carriage unit, a similar procedure can be used to reset such head error, set the carriage unit to the head replacement position and, after the cover is closed, perform the ejection performance recovery operation. After this, the apparatus needs only to be set to the print standby mode.

Figure 7:
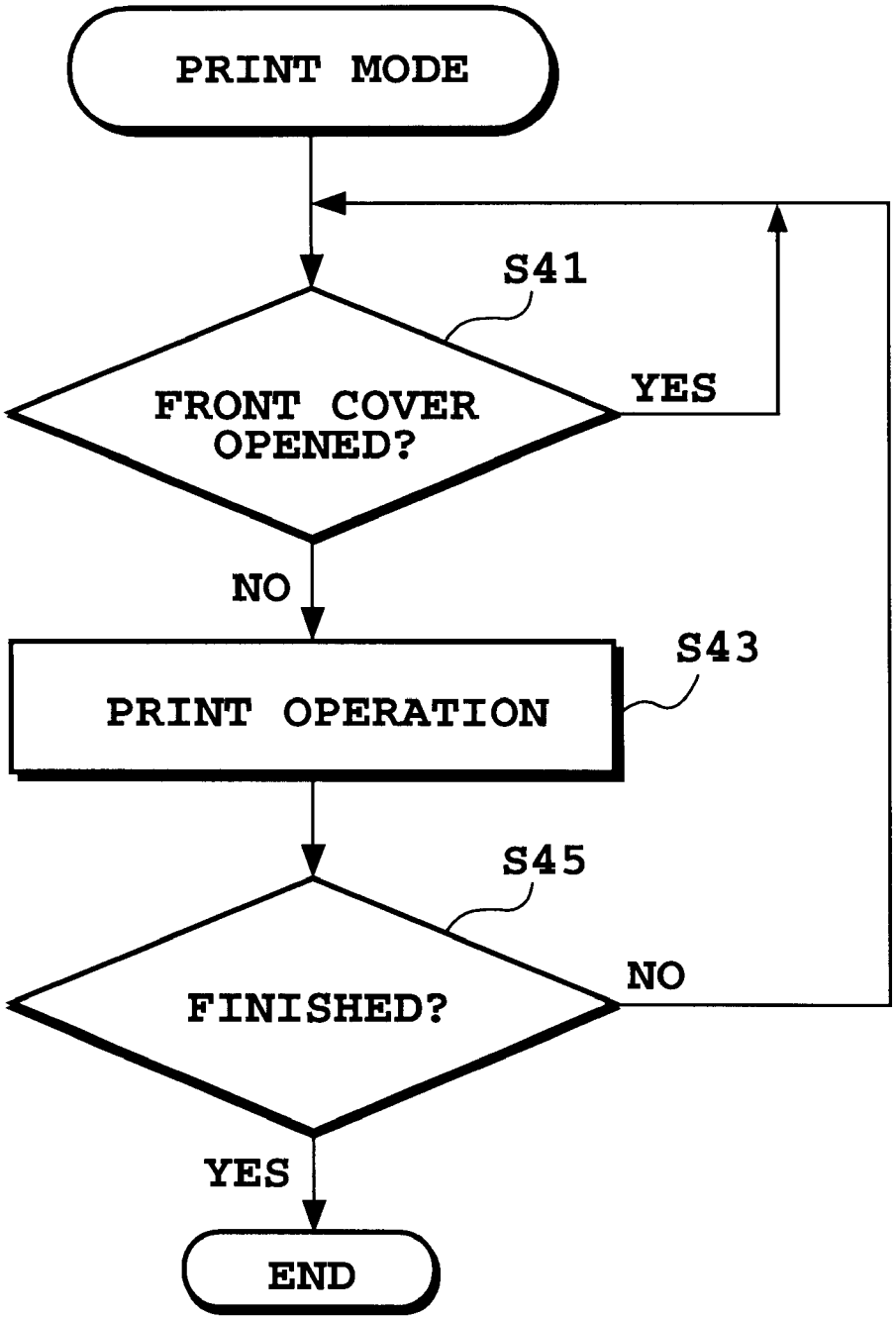
FIG. 7 is a flow chart showing an example procedure when the front cover is opened during a print mode.

FIG. 7 shows an example procedure performed during the print mode. When in this mode the front cover FC is found to be open, the printing operation is stopped without moving the carriage unit 2 to the head replacement position, thereafter waiting for the cover to be closed (step S41). When the cover is closed, the printing operation is resumed to perform a predetermined unit scan (e.g., one scan) at a time (step S43). This procedure is repeated until the processing is finished with all print data (step S45).

When the front cover FC is opened when the scanner head is performing the reading operation, a similar procedure can be performed, i.e., only stopping the scan operation without moving the carriage unit to the head replacement position, then waiting for the cover to be closed, and resuming the scan operation upon closure of the cover.

[Further Descriptions]

It should be noted that the present invention may be applied to not only the above printing apparatus on which the head cartridge for forming an image (print head) and the scanner head for reading an image are selectably mounted, but also to any type of scanning apparatus on which a function device is detachably mounted. For instance, the present invention may be applied to any printing apparatus similar to the above printing apparatus excepting that the scanner head cannot be mounted. To the contrary, the present invention may be applied to any reading apparatus on which various scanner heads are detachably mounted while on which a print head for forming image cannot be mounted. Further, the present invention may be applied to any scanning apparatus on which both of the print head and the scanning head are simultaneously mounted, and which enables a predetermined replacement operation associated with at least one of the heads.

Moreover, in applying to a printing apparatus, the present invention may be applied to not only the one using the ink jet head mentioned above, but also to various types of serial printers such as a heat transfer printer, a dot matrix printer or a typewriter.

However, in the case that an ink jet printing method is applied, the present invention achieves distinct effects when applied to a print head or a printing apparatus which has means for generating thermal energy such as electrothermal transducers or laser light, and which causes changes in ink by the thermal energy so as to eject ink. This is because such a system can achieve high density and high resolution printing.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to generate thermal energy corresponding to printing information; second, the thermal energy induces a sudden temperature rise that exceeds the nucleate boiling so as to cause the film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consist of a plurality of print heads combined together, or one integrally arranged print head.

In addition, the present invention can be applied to various serial type print heads: a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can be also changed. For example, only one print head corresponding to a single color ink, or a plurality of print heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through-holes formed in a porous sheet as liquid or solid substances so that the ink faces the electrothermal transducers as described in Japanese Patent Application Laid-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

As understood from the foregoing description, the present invention makes it possible to realize a scanning apparatus with an excellent operability and operation efficiency which properly changes, according to the state of the apparatus, operation settings of the apparatus while the front cover is open.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A scanning apparatus for scanning a function device and a medium relative to each other to have said function device execute a predetermined function, comprising:

a cover member for opening and closing an interior of said apparatus;

means for detecting an open/closed state of said cover member;

means for making a setting to enable a predetermined mounting and dismounting operation associated with said function device; and control means for permitting the setting to enable the predetermined mounting and dismounting operation when said cover member is detected to be opened while said apparatus is in a predetermined function execution standby state, and for controlling to disable the predetermined mounting and dismounting operation when said cover member is detected to be opened while said apparatus is in a predetermined function execution state.

2. A scanning apparatus as claimed in claim 1, wherein said function device is mounted on a scan member scanned over the medium in a predetermined direction and can execute the predetermined function in the process of the scanning, and said setting means, when the setting is permitted, sets said function device to a predetermined position in the predetermined direction at which the predetermined mounting and dismounting operation is enabled.

3. A scanning apparatus as claimed in claim 2, wherein said function device is a print head that can execute a print function by applying a print agent to said medium.

4. A scanning apparatus as claimed in claim 3, wherein said print head can be mounted on and dismounted from said scan member and the predetermined mounting and dismounting operation is an operation of replacing said print head.

5. A scanning apparatus as claimed in claim 4, wherein said print head is combined with an ink tank containing an ink as the print agent, and the predetermined mounting and dismounting operation is an operation of replacing said print head together with said ink tank or replacing only said ink tank.

6. A scanning apparatus as claimed in claim 3, further comprising means for, when the closed state of said cover member is detected after said setting, moving said print head from the predetermined position to an initial position.

7. A scanning apparatus as claimed in claim 6, wherein said print head is an ink jet print head for ejecting ink, further comprising means for performing an ejection performance recovery operation to maintain the ejection performance of said ink jet print head, and when said print head is moved from the predetermined position to the initial position, the ejection performance recovery operation is performed.

8. A scanning apparatus as claimed in claim 7, further comprising means for, when the closed state of said cover member is detected without the replacement being performed after said setting, setting said print head to said standby state again without starting the ejection performance recovery operation.

9. A scanning apparatus as claimed in claim 3, wherein said standby state is a state in which data to be printed can be received and in which there is no error.

10. A scanning apparatus as claimed in claim 3, wherein when said cover member is opened according to a detection of an error caused by an absence of a medium to be printed, said apparatus resets the error and permits said setting.

11. A scanning apparatus as claimed in claim 3, wherein when said cover member is opened according to a detection of an error caused by an abnormal feeding of a medium to be printed, said apparatus does not permit said setting and waits for the abnormal feeding to be eliminated.

12. A scanning apparatus as claimed in claim 3, wherein when said cover member is opened during a printing operation, said apparatus does not permit said setting, stops the printing operation and waits for said cover member to be closed.

13. A scanning apparatus as claimed in claim 3, wherein said print head comprises an ink jet print head having an electrothermal transducer to generate thermal energy for causing film boiling in ink to eject the ink.

14. A scanning apparatus as claimed in claim 3, wherein said print head and a scanner head for reading an image can be removably mounted on said scan member and are interchangeable with one another.

15. A scanning apparatus as claimed in claim 14, wherein when said cover member is opened according to a detection of an error caused by a reception of data to be printed while said scanner head is mounted, said apparatus resets the error and permits said setting.

16. A scanning apparatus as claimed in claim 14, wherein when said cover member is opened during an image reading operation, said apparatus does not permit said setting, stops the reading operation and waits for said cover member to be closed.

17. A control method of a scanning apparatus having a carriage for detachably mounting a function device for executing a predetermined function and means for scanning said carriage along a main scanning direction, said scanning apparatus making said function device mounted on said carriage execute the predetermined function during main scanning of said carriage, said method comprising the steps of:

making a setting to enable a predetermined mounting and dismounting operation associated with said function device;

detecting an open/closed state of a cover member of said apparatus, said cover member being disposed to cover a predetermined space including a position at which the predetermined mounting and dismounting operation of said function device mounted on said carriage is enabled; and controlling so as to permit the setting to enable the predetermined mounting and dismounting operation when said cover member is detected to be opened while said apparatus is in a standby state of the predetermined function executable by said function device, and not to permit the setting to enable the predetermined mounting and dismounting operation when said cover member is detected to be opened while said apparatus is in an execution state of the predetermined function executable by said function device.

18. A printing apparatus having a carriage for detachably mounting a unit for executing a predetermined function and means for scanning said carriage along a main scanning direction, in a state that a print head for executing a printing function is mounted on said carriage as said unit, said apparatus controlling said print head to execute the printing function during main scanning of said carriage, said apparatus comprising:

a cover for opening and closing an interior of said apparatus, said cover being disposed to cover a predetermined space including a replacement position for replacing said unit mounted on said carriage, the replacement position being in an area in which said carriage is scanned by said scanning means;

means for judging a state of said apparatus;

means for detecting a state of said cover; and means for controlling to scan said carriage to the replacement position by said scanning means or not according to a judgment result by said judging means, when a detection that said cover is displaced from a closed state to an open state is made based on a detection result by said detecting means, wherein said control means does not scan said carriage to the replacement position when said apparatus is judged by said judging means to be in a state to execute the printing function, and scans said carriage to the replacement position when said apparatus is judged by said judging means to be in a standby state.

19. A control method of a printing apparatus having a carriage for detachably mounting a unit for executing a predetermined function and means for scanning said carriage along a main scanning direction, in a state that a print head for executing a printing function is mounted on said carriage as said unit, said apparatus controlling said print head to execute the printing function during main scanning of said carriage, said method comprising the steps of:

detecting an open/closed state of a cover of said apparatus, said cover being disposed to cover a predetermined space including a replacement position for replacing said unit mounted on said carriage, the replacement position being in an area in which said carriage is scanned by said scanning means;

judging a state of said apparatus; and controlling the scanning of said carriage by said scanning means when said cover is displaced from a closed state to an open state, and controlling to scan said carriage to said replacement position by said scanning means or not according to the state of said apparatus, wherein in said controlling step, said carriage is not scanned to the replacement position when said apparatus is judged in said judging step to be in a state to execute the printing function, and said carriage is scanned to the replacement position when said apparatus is judged in said judging step to be in a standby state.

* * * * *

UNITED STATES PATENT AND TRADEMARK OFFICE

CERTIFICATE OF CORRECTION

PATENT NO. : 6,450,610 B1 
DATED : September 17, 2002
INVENTOR(S) : Shimura

It is certified that error appears in the above-identified patent and that said Letters Patent is hereby corrected as shown below:

Column 2,
Lines 3 and 25, “to” should be deleted.
Lines 36 and 61, “to scan” should read -- the scanning of --.

Column 4,
Line 32, “inseparable” should read -- to be inseparable --.
Line 62, “like.” should read -- like.
A nonvolatile memory 105 stores settings of the printing apparatus, such as the kinds of font and print medium and may use an EEPROM. --.

Column 7,
Line 53, “excepting” should read -- except --.
Line 63, “applying” should read -- applying the invention --.

Column 8,
Line 36, “to” should read -- into --.

Signed and Sealed this

Fifteenth Day of April, 2003

JAMES E. ROGAN
*Director of the United States Patent and Trademark Office*